United States Patent [19]

Nozaki

[11] Patent Number: 4,627,714

[45] Date of Patent: Dec. 9, 1986

[54] RECORDING APPARATUS WITH CONTROLLED POWER SOURCE FOR HEAT FUSING DEVICE

[75] Inventor: Hiromi Nozaki, Hachioji, Japan

[73] Assignee: Konishiroku Photo Industry Co., Ltd., Tokyo, Japan

[21] Appl. No.: 499,183

[22] Filed: May 31, 1983

[30] Foreign Application Priority Data

Jun. 8, 1982 [JP] Japan ..... 99027

[51] Int. Cl.[4] ..... G03G 13/20; G03G 15/20

[52] U.S. Cl. ..... 355/14 FU; 219/216; 355/3 FU; 432/60

[58] Field of Search ..... 355/3 FU, 14 FU; 219/216; 432/60

[56] References Cited

U.S. PATENT DOCUMENTS

| | | | |
|---|---|---|---|
| T100,804 | 7/1981 | Ernst | 355/14 FU |
| 3,790,747 | 2/1974 | Klavsons et al. | 219/216 |
| 4,006,985 | 2/1977 | Hutner | 355/14 FU |
| 4,113,375 | 9/1978 | Murata et al. | 355/14 FU |
| 4,435,677 | 3/1984 | Thomas | 355/14 FU X |

*Primary Examiner*—Fred L. Braun

*Attorney, Agent, or Firm*—Frishauf, Holtz, Goodman & Woodward

[57] ABSTRACT

A recording apparatus such as a photocopier, includes a heat fusing device and a power source connected thereto via a power controller. The power controller controls the supply of power to the heat fusing device such that full power is supplied to the heat fusing device during a recording operation, and reduced power is supplied to the heat fusing device during a given period of time beginning from the completion of a recording operation, the power controller reducing the power supplied to the heat fusing device in accordance with a given function of time over the given period of time. The power controller cuts off completely the supply of power to the heat fusing device at the end of the given period of time beginning after the completion of a recording operation.

21 Claims, 4 Drawing Figures

RECORDING APPARATUS WITH CONTROLLED POWER SOURCE FOR HEAT FUSING DEVICE

BACKGROUND OF THE INVENTION

1. Field of the Invention

The invention relates to a recording apparatus having a heat fusing device and, more particularly, to a recording apparatus that cuts off the electric power source of the heat fusing device when a certain period of time has passed after completing a recording operation such as a copying operation.

2. Description of the Prior Art

In recent years, in recording systems, there has been provided an automatic shutoff device so that an electric load of a heat fusing device and the like consuming a large amount of electrically may be automatically shut off when a certain period of time has passed after completing a recording operation.

In such a conventinal type of recording apparatus as a copying mahcine, 100 % of the electric power supplied to the heat fusing device was cut off when a certain period of time passed. Therefore, in the case of the conventional apparatus, there is a problem that it takes longer from the time when a new turn on state is initiated until the time when the temperature is raised to satisfactorily be fixable, because the period of a shutoff time becomes longer if an intermittently unused period is longer and therefore the heat fusing device becomes cold. This problem may of course be solved by setting longer the delay period before shutting off the power. However, such a countermeasure is contrary to the object for saving electric power. As mentioned above, in the conventional apparatus, it has been difficult to effectuate both power-savings and instant operability, and users have not always been satisfied.

SUMMARY OF THE INVENTION

It is an object of the invention to provide a recording apparatus in which a great effect of power-savings and an excellent instant operability may be enjoyed by regulating the power supplied to the heat fusing device for the period from the time of completion of a recording operation to the time of cutting off the power source, as a function of time elapsed from the moment of completing the recording operation.

DETAILED DESCRIPTION OF THE INVENTION

Figure 1:
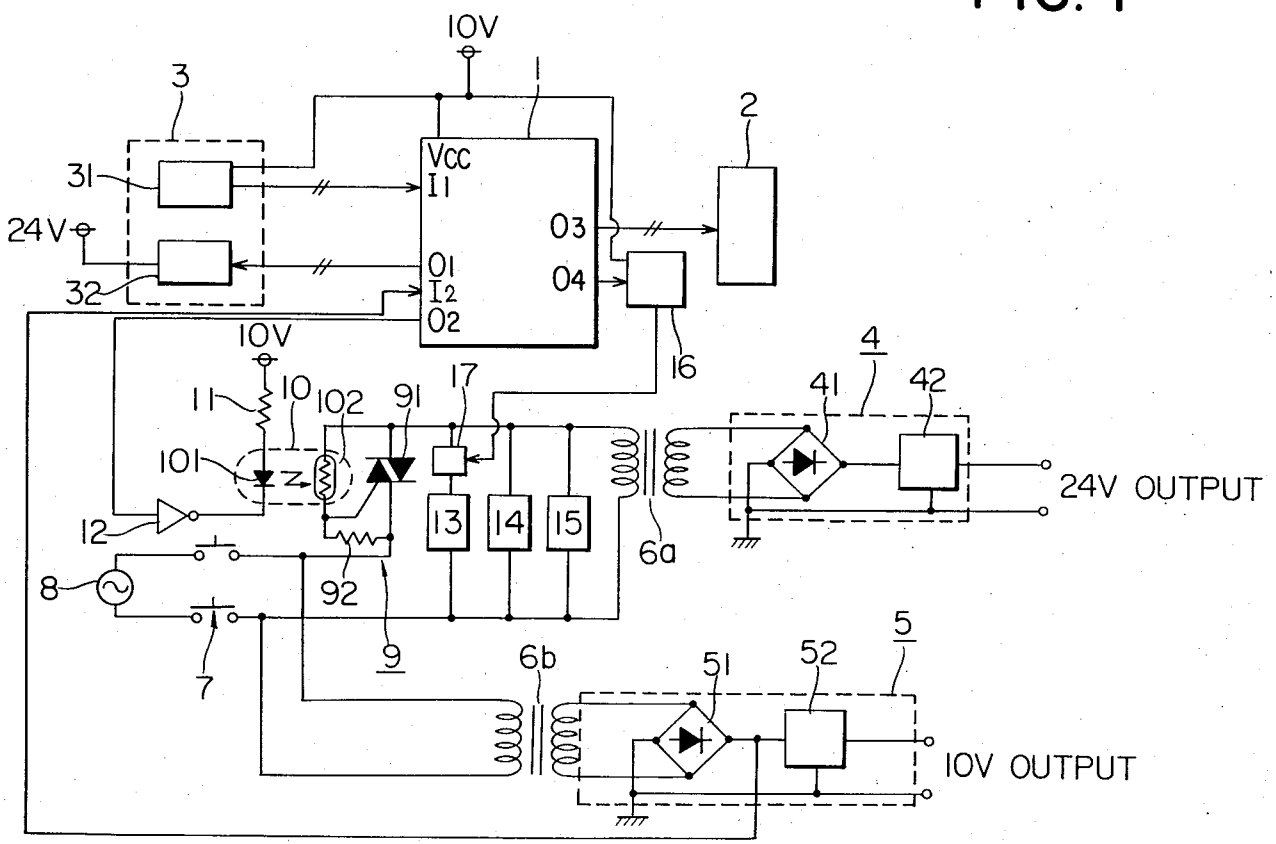
FIG. 1 is a circuit diagram showing a substantial part of one example of a copying apparatus to which the invention is applied.

FIG. 1 is a circuit diagram illustrating the substantial parts of an example relating to a copying apparatus of the invention, wherein 1 is a regulating section for which a microcomputer is used. A unit 2 comprises a heat fusing device controlling section regulated by the regulating section 1, an exposure controlling section, a high-voltage unit, a motor-drive section and the like.

An operating section 3 has a key-input section 31 and a display section 32. 4 is a driving power source circuit, wherein an AC voltage generated from the secondary winding of transformer 6*a* is full-wave-rectified by diode-bridge 41 and is then converted into DC 24 V by mens of a constant-vapor circuit 42 which provides the DC 24 V output. 5 is a power source circuit for controlling circuits wherein an AC voltage generated from the secondary winding of transformer 6*b* is full-wave-rectified by diode-bridge 51 and is then converted into DC 10 V by means of constant-voltage circuit 52, which provides the DC 10 V output.

The output voltage of 24 V is supplied from driving power source circuit 4 to the abovementioned unit 2 and to display section 32 of operating section 3, as the power source voltage.

The output voltage of 10 V is supplied as the power source voltage from power source circuit 5 to controlling circuits such as regulating section and key-output section 31.

Voltage from commercial power source 8 is applied, through manually controllable main switch 7, to the primary winding of transformer 6*a*, and the voltage from the commercial power source 8 is directly applied to the primary winding of transformer 6*b*. Between mainswitch 7 and one end of the primary winding of transformer 6*a*, there is interposingly connected a triac circuit 9 which is controlled by the output of photocoupler 10. The output voltage of 10 V is supplied from controlling power source circuit 5 to photocuopler 10 through resistor 11 and photocoupler 10 is driven by inverter 12 receiving the output (port $O_2$) of regularing section 1. For example, when the output of output port $O_2$ of regulating section 1 becomes "H" (high), the output of inverter 12 becomes "L" (low) and light emitting diode 101 of photocoupler 10 is turned on and thus the resistance value of internal resistor 102 of a decoder on the photo acceptance side, such as a CdS cell or the like will decrease. The voltage across internal resistor 102 is thereby decreased, and triac 91 becomes in an ON-state so that the commercial power source is thus applied to transformer 6*a* through tric 91. When output of output port $O_2$ of regulating section 1 becomes "L" (low), the voltage across in resistor 102 of photocoupler 10 increases and triac 91 becomes in an OFF-state and therefore only a very weak current is supplied to transformer 6*a* through resistor 102 and the commercial power voltage application to transformer 6*a* becomes substantially in a shutoff state. To the output side of triac circuit 9, there are connected heat fusing device 12 such as heat roll fusing or heat plate fusing device, main motor 14, an exposure lamp and the driving circuit 15 thereof, each of which is driven by the commercial power source voltage, in parallel with transformer 6*a*.

Further, heat fusing device 13 is connected in series with power control element 17 driven by wave shaping circuit 16. This wave shaping circuit 16 functions to receive the power source voltage of 10 V from controlling power source circuit 5 and to generate an output of a series of trigger pulses to power control element 17 every time output pulses generated from output port $O_4$ of regulating section 1 are received.

Output pulses from output port $O_4$ are generated only when regulating section 1 detects a zero cross point of the AC voltage which is full-wave-rectified by diode-bridge 51. $I_2$ is an input port of regulating section 1 to receive the full-rectified voltage from diode-bridge 51.

Now, referring to FIG. 2 and FIG. 3, the operation of the apparatus of the invention will be described.

In the state where main switch 7 is ON and commercial power voltage is applied to a copying machine and when a copying operation is kept running, the output of output port $O_2$ of regulating section 1 becomes "H" (high), and thereby LED 101 is energized, and triac 91 becomes in an ON state. Accordingly, electric power is supplied from commercial power source 8 to heat-fixing device 13, main motor 14, an exposure lamp, the driving circuit 15 and the like, respectively and at the same time an AC voltage is applied respectively to power source circuits 4, 5 through transformers *6a*, *6b*, and thus, the outputs of 24 V and 10 V are generated.

If a commercial power source 8 of 50 Hz is used, a pulse train of 100 pulses/sec is generated from output port $O_4$ during a copying operation and during a predetermined period of time $T_1$ after completion of the copying operation.

When a copying operation is completed, regulating section 1 reads a clock signal to count the passage of time. If a fixed signal, including those generated for a magnification operation, density adjustment and the like as well as the signals generated by a copy start button, reaches regulating section 1 within a fixed period of time $T_1$ e.g.; 2 minutes, for resuming copying operations, then the read value is cleared off and a similar operational state to the abovementioned is restored. When the fixed period of time $T_1$ elapsed before the abovementioned signal for resuming an operation is supplied, regulating section 1 generates a pulse train of fixed period from output port $O_4$ thereof to wave-shaping circuits 16 according to a first pulse generation routine. (See FIG. 2). Therefore, trigger pulses of a longer period than the period of before $T_1$ are supplied from wave-shaping circuit 16 to power control element 17. The power supply to heat fusing device 13 is therefore decreased as illustrated in FIG. 3. When time reaches $T_2$, regulating section 1 further decreases the power supply to heat fusing device lower pitch, according to a second pulse generating routine, and when the time is further passed over to reach time $T_3$, the power supply to heat fusing device 13 is further reduced according to a third pulse generating routine. The numbers of pulses generated from output port $O_4$ according to the first, second and third pulse generation routine in one second are $A_1$, $A_2$ and $A_3$ respectively, wherein $100>A_1>A_2>A_3$. When time reaches $T_4$, regulating section 1 changes the output signal of output port $O_2$ to "L" (low) for this time. Therefore, photocoupler 10 is neutralized and triac 91 is switched to an OFF state, and thus the power supply from the commercial power source becomes cut-off, that is, an auto-shut-off state. Because of this state, power supplied to heat fusing device 13 and others are cut-off and, at the same time, power supply to transformer *6a* is also cut-off, and thus, the output from constant-voltage circuit 42 is dropped to zero. Thus, sections consuming much pwer except a part of a copying apparatus are cut off from the power supply. However, the output voltage of 10 V is suppled as the power voltage from control power source circuit 5 respectively to regulating section 1, key input secion 31, wave-shaping circuit 16 and photocoupler 10, so that each of these devices are kept ready to operate. In this example, it is also possible to make display section *32a* display an auto-shutoff state in the manner that, though the display section 32 is turned off at the time of an auto-shutoff state, the display secion 32 comprises a less power-consuming display element such as a liquid-crystal display element and the like, and that power is supplied from control power source circuit 5 at the time of an auto-shutoff state.

In such an auto-shut-off state and when information is fed from key-input section and the like, regulating section 1 receives the information and judges the contents of the received signals and then changes the output signal of output port $O_2$ to "H" so as to release a shut-off state, and thus, a copying process is resumed by restoring triac 91 into an ON state. For example, when a selected copy number "5" is fed from key-input section 31 in the period of an auto-shutoff state, the selected copy number "5" is displayed on display section 32 which has been neutralized, and other displays are also reenergized. At the same time, power is supplied to every part of the copying apparatus and therefore the copying apparatus is restored to be ready to operate copying after the heat fusing device thereof is warmed up.

Figure 2:
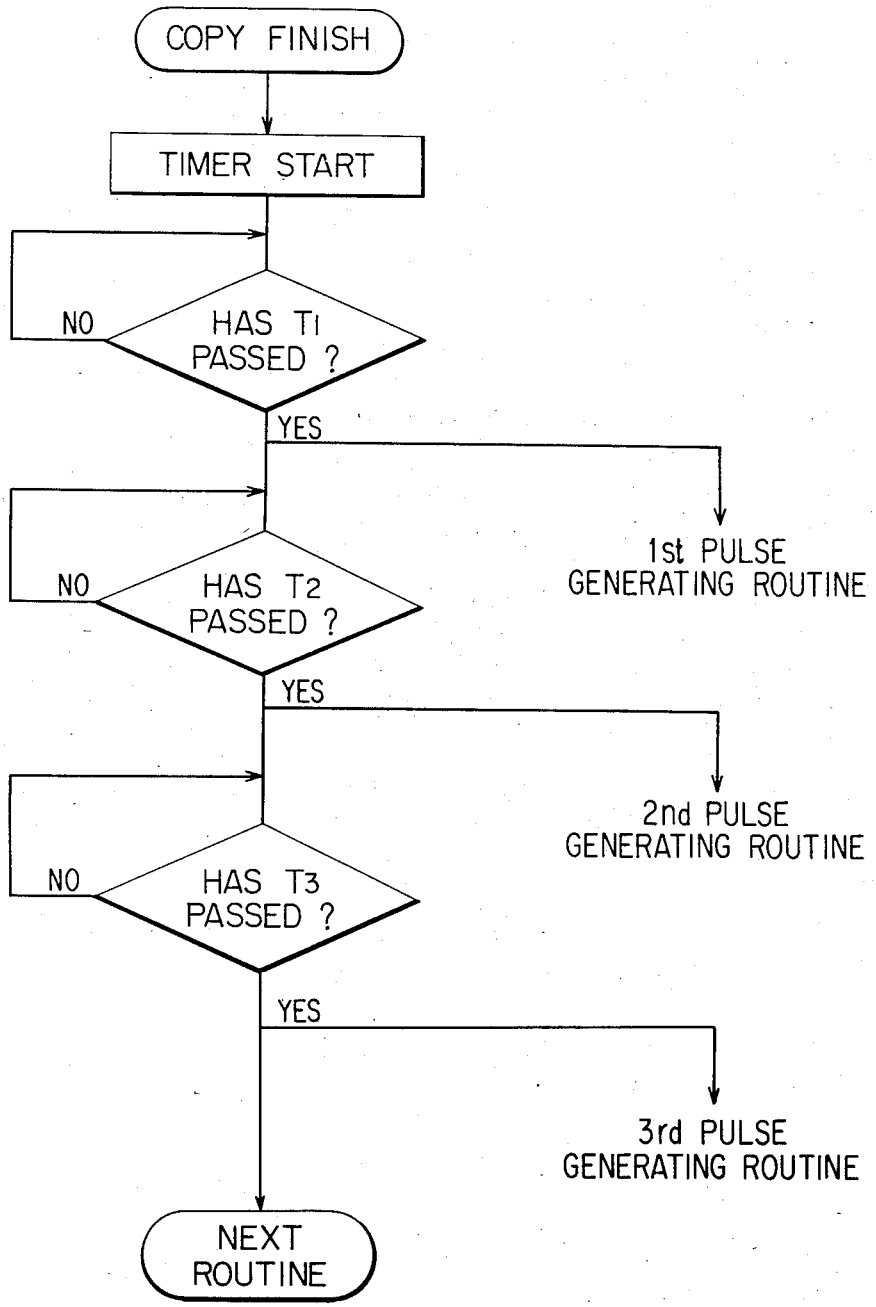
FIG. 2 is a flow-chart illustrating the operation of the apparatus shown in FIG. 1.
Figure 3:
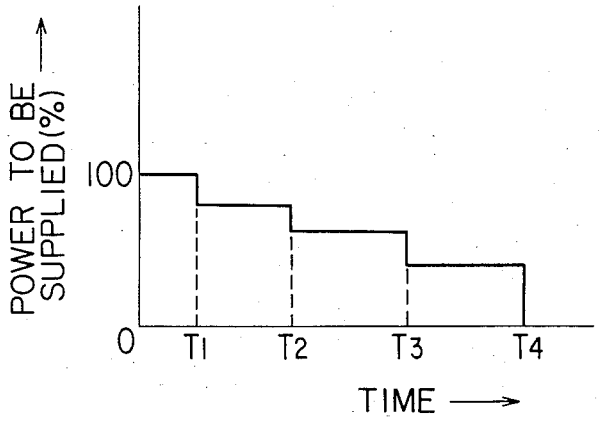
FIG. 3 is a diagram illustrating power supplied to a heat fusing device as a function of time.
Figure 4:
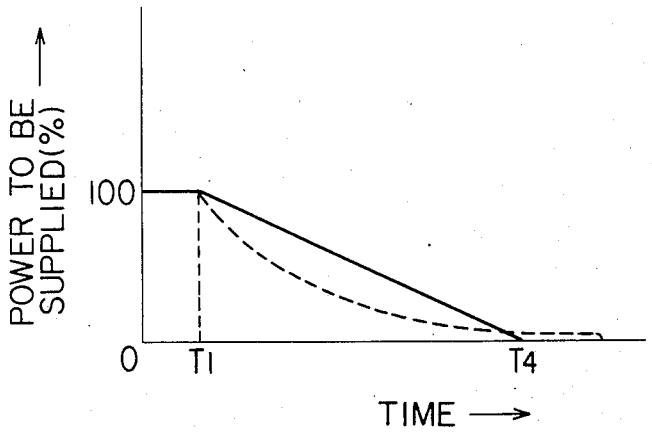
FIG. 4 is a diagram illustrating another example of the power supplied to the heat-fusing device and function of time.

In addition, the power supply to heat fusing device 13 shall not be limited to those shown in FIG. 2 and FIG. 3, but may also be selected variously from those having voltage-time characteristics as shown in by the solid line and the dashed line in FIG. 4. It is further contemplated to determine a set condition suitable for a user if such power supply is so arranged as to be able to change or to switch over. It is still further contemplated to input characteristic curves to a memory so as to read out the characteristic curves in place of obtaining such curves from a program. Besides the above, use may be made of any of publicly known methods to control power supply for heat-fixing device 13. Still further, the abovementioned auto-shut-off systems shall not be limited to a copying devices but to the other types of recording apparatuses.

Even in a recording apparatus not having been provided with an auto-shutoff system, it is possible to enjoy a power-saving effect if the apparatus is constituted in such a way that the power-supply to the heat fusing device thereof is dropped gradually according to a certain function during the course from the finish to a recording to a main-switch OFF, so that about 20 to 50% of normal supply of power is ultimately kept supplied to the device.

As described above, in the invention, power supply to a heat-fixing device is controlled by a given function during the time lapse from the finish of a recording operation, and thus the power-saving effect becomes great. The invention provides a longer period of time before cutting off the power-supply to the heat fusing device in comparison with the period needed for conventional apparatuses. Accordingly, the readiness for a next operation may be improved. Consequently, it is possible to materalize a recording apparatus having a great power-saving effect and an excellent operational readiness.

What is claimed is:

1. In a recording apparatus having a heat fusing device and a power source for said heat fusing device, a method of controlling the supply of power to said heat fusing device, comprising:

supplying power from said power source to said heat fusing device to produce a predetermined heat temperature at said heat fusing device during a recording operation;

controlling power supplied from said power source to said heat fusing device during a first given period of time beginning after the completion of a recording operation to maintain said heat fusing device at a given temperature sufficient for recording, and after said first given period of time, gradually reducing the power supplied to said heat fusing device in accordance with a given function of time over a second given period of time such that at the end of said second period of time the supply of power from said power source to said heat fusing device is completely cut off.

2. The method of claim 1, wherein said gradually reducing step comprises decreasing said power supplied to said heat fusing device in a stepwise manner in accordance with said given function of time.

3. The method of claim 1, wherein said gradually reducing step comprises decreasing said power supplied to said heat fusing device in a continuous manner in accordance with said given function of time.

4. The method of claim 3, wherein said continuous decrease of said power is a linear continuous decrease.

5. The method of claim 3, wherein said continuous decrease of said power is a non-linear continuous decrease.

6. The method of claim 1, wherein said given function of time is a selectively variable function of time.

7. The method of claim 1, wherein said second given period of time begins a predetermined period of time after the completion of a recording operation.

8. The method of claim 7, wherein full power is supplied to said heat fusing device during said first given period of time.

9. In a recording apparatus having a heat fusing device, a power source for supplying power to said heat fusing device, and means for cutting off the supply of power to said heat fusing device after the lapse of a given period of time after completion of a recording operation, the improvement comprising control means coupled to said heat fusing device and to said power source for controlling the supply of power to said heat fusing device, said control means comprising:

means for supplying power from said power source to said heat fusing device to produce a predetermined heat temperature at said heat fusing device during a recording operation;

means for supplying power from said power source to said heat fusing device during a first given period of time beginning after the completion of a recording operation to maintain said heat fusing device at a given temperature sufficient for recording;

means for gradually reducing the power supplied from said power source to said heat fusing device during a second given period of time beginning after the end of said first period of time in accordance with a given time function over said second given period of time; and means for cutting-off completely the supply of power from said power source to said heat fusing device at the end of said second given period of time.

10. The apparatus of claim 9, wherein said gradually reducing means of said control means decreases said power supplied to said heat fusing device in a stepwise manner during said second given period of time.

11. The apparatus of claim 9, wherein said gradually reducing means of said control means decreases said power supplied to said heat fusing device in a continuous manner during said second given period of time.

12. The apparatus of claim 11, wherein said continuous decrease of power supplied to said heat fusing device is a substantially linear continuous decrease.

13. The apparatus of claim 11, wherein said continuous decrease of said power supplied to said heat fusing device is a non-linear continuous decrease.

14. The apparatus of claim 9, wherein said given function of time is a selectively variable function of time.

15. The apparatus of claim 9, wherein said second given period of time begins a predetermined period of time after the completion of a recording operation.

16. The apparatus of claim 15, wherein full power is supplied to said heat fusing device during said first given period of time 17. The apparatus of claim 9, wherein said gradually reducing means of said control means comprises a variable power attenuator coupled between said power source and said heat fusing device.

18. The apparatus of claim 17, wherein said gradually reducing means of said control means further comprises means coupled to said power attenuator for controlling the attenuation thereof.

19. The apparatus of claim 9, wherein said gradually reducing means of said control means includes a wave shaping circuit coupled to said power source for generating signals in accordance with said given function of time.

20. The apparatus of claim 19, wherein said gradually reducing means of said control means includes logic means for controlling said wave shaping circuit.

21. The apparatus of claim 20, wherein said logic means of said control means includes means for generating a first plurality of pulses for controlling power during a first time period during said second given period of time, for generating a second plurality of pulses for controlling the power supply to the heat fusing device to be lower than that provided by said first plurality of pulses, said second plurality of pulses being generated for a second period of time beginning at the end of said first period of time, and for supplying a third plurality of pulses during a third period of time beginning at the end of said second period of time for controlling the power supplied to said heat fusing device to be lower than the power produced by said second plurality of pulses, and for then completely cutting off the power to said heat fusing device at the end of said third period of time.

* * * * *